US006057529A

United States Patent [19]

Kirby

[11] Patent Number: 6,057,529

[45] Date of Patent: May 2, 2000

[54] COMBINATION TEMPERATURE SENSOR, WARNING LIGHT SENSOR AND LIGHT INDICATOR FOR HEATING ELEMENTS

[75] Inventor: Robert L. Kirby, Sparta, Tenn.

[73] Assignee: Tutco, Inc., Wayne, Pa.

[21] Appl. No.: 09/086,523

[22] Filed: May 29, 1998

[51] Int. Cl.[7] ..... H05B 3/68; H05B 1/02

[52] U.S. Cl. ..... 219/445.1; 219/446.1; 219/510

[58] Field of Search ..... 219/445.1, 446.1, 219/448.14, 448.18, 448.19, 490, 494, 509, 510

[56] References Cited

U.S. PATENT DOCUMENTS

| | | | |
|---|---|---|---|
| 4,388,520 | 6/1983 | McWilliams . | |
| 4,518,850 | 5/1985 | Grasso | 219/505 |
| 5,103,077 | 4/1992 | Goessler et al. . | |
| 5,138,135 | 8/1992 | Husslein et al. . | |
| 5,448,036 | 9/1995 | Husslein et al. . | |

*Primary Examiner*—Sam Paik
*Attorney, Agent, or Firm*—Patton Boggs LLP

[57] ABSTRACT

A switch which controls a heating element in terms of limiting its overheating and indicating both that the heating element is on and that it has a hot surface associated therewith is disclosed, particularly for use with range top cooking elements.

7 Claims, 2 Drawing Sheets

COMBINATION TEMPERATURE SENSOR, WARNING LIGHT SENSOR AND LIGHT INDICATOR FOR HEATING ELEMENTS

FIELD OF THE INVENTION

The present invention relates to a combination temperature sensor, a warning light sensor and a light indicator for heating elements and, in particular, to physically locating a warning light for each heating element in a high temperature limit as an integral part of a control for heating elements such as glass top range elements.

BACKGROUND ART

In the prior art, each glass top range element has a high temperature limit that operates according to the rod expansion principle. The high temperature limit consists of a quartz tube with an expansion or sensing rod inside and a dust protected ceramic head with a built-in snap action mechanism to make and break two sets of contacts. The first set of contacts controls a common, remote warning light circuit, and the second set of contacts controls the power to the heating element.

With present day technology, the electric range has a glass/ceramic cooking top upon which rests the cooking utensils. One or more electric resistance heating elements are mounted on the underside of the glass/ceramic top. There is a high temperature limit mounted on each heating element. When a heating element is energized, the sensing rod in the high temperature limit expands as the temperature rises and closes the first set of contacts, thereby allowing current to flow to a single common centrally located remote warning light. This light informs the user that a section of the glass is hot, but not which section. This could result in an injury to the end user of the product.

A prior art circuit and switch are depicted in FIG. 1 and a description of a sequence of operation for such a standard limit switch is as follows.

In the first step, an infinite switch 1 is manually turned on. With the switch on, current flows from the main power supply L1 through the infinite switch 1 to the common remote power-on indicator light 3, and through the high temperature limit-hot light switch unit 4. The unit 4 includes a limit switch 5 that employs a normally closed set of contacts 9 and 11, a hot light switch 17, that employs a normally open set of contacts 19 and 21, and a sensing rod 15 positioned so as to monitor the temperature of the heating element 13 and the glass (not shown). The current flows through the closed set of contacts 9 and 11 to the heating element 13, and back to the main power supply L2.

In a second step, the heating element 13 starts to heat as a result of the infinite switch 1 being turned on. As the temperature at the heating element 13 rises, the sensing rod 15 in the unit 4 starts to expand. At a predetermined point, the sensing rod 15 expands and closes the hot light switch 17. When the switch 17 closes as a result of the expansion of the rod 15, contacts 19 and 21 are connected completing the circuit and the common remote warning light 23 on a control panel is energized, thereby indicating that a hot surface exists on the range top.

As the heating element 13 continues to heat, the sensing rod 15 in the unit 4 expands further and breaks the contact between 9 and 11, thereby disconnecting the power to the heating element 13. As the heating element 13 cools, the sensing rod 15 cools and its length decreases to close switch 5 and make connection again between the contacts 9 and 11.

Continued heating and cooling affects the length of the sensing rod 15 and the heating element 13 cycles off and on as switch 5 opens and closes. This cycling action thereby limits the heating element's output to a safe level.

In a third step, the heating element 13 is turned off by turning the infinite switch 1 to the off position. The power to the heater is then interrupted. However, the hot light 23 remains on until the sensing rod 15 in the unit 4 shortens sufficiently to open the switch 17, indicating that the glass or cooking surface has cooled to a point below a predetermined temperature deemed safe for the end user to touch without injury.

The circuit depicted above does not tell a user as to which range top surface is at a dangerous temperature. In light of this deficiency in the prior art, a need has developed to provide an improved limit switch and circuit for heating elements, particularly those associated with cooking stoves using electrical heat for cooking. The present invention solves this need by providing a switch that both indicates that power is supplied to a given heating element and that that particular element is unsafe to touch since it is too hot, regardless of whether power is being supplied to the element.

SUMMARY OF THE INVENTION

One object of the invention is an improved circuit for controlling stove top heating elements.

Another object of the invention is an improved switch for use with heating elements.

A further object of the invention is the combination of a high temperature warning light and a high temperature limit switch incorporated into a single switching unit.

Yet another object of the invention is the use of the aforementioned combination with one or more heating elements.

One other object is a method of indicating when each burner amongst a number of burners on a stove top is too hot to touch.

In satisfaction of the foregoing objects and advantages, the present invention comprises, in its broadest embodiment, an improvement in high temperature limit-hot light switches. In these prior art switches, a sensing rod expands and contracts to make or break connection between two or more contacts. Normally, after heating up, the rod will expand and make contact between two contacts to energize a common warning light that indicates that a heating element surface is too hot to touch. Once the element is turned off, the rod eventually contracts and the warning light goes off, thereby indicating that the surface is safe to touch. Theses switches are also capable of disconnecting power to the element if the temperature goes too high, i.e., a limiting action on excessive heating element temperature. That is, upon further heating, the rod expands even more and disconnects the power source to the heating element. Cooling then causes the rod to contract and permits the element to be energized again. The rod is designed so that this cycle could be repeated continually with the common hot surface warning light remaining on.

The invention comprises an improvement in high temperature limit-hot light switches typically used in glass top range elements by including a warning light with each limit switch. In addition, means for connecting power to the warning light is provided, both when the heating element is powered and when a heating element surface is at an unsafe temperature, regardless of whether the heating element is energized for heating.

In a preferred embodiment, the invention comprises a switch unit having a set of five contacts with a temperature sensitive rod. With the rod in the cold condition, i.e., power just connected to the heating element, the connection between a set of first and second contacts is normally closed. As described below, this switch acts as a limit switch. The rod, still relatively cool, also makes contact between third and fourth contacts (normally closed) to energize a light, thereby indicating that power to the specific heating element is on. The light also functions as a hot or warning light by reason of a switching arrangement between the third and fourth contacts and an additional fifth contact as described below.

When the rod expands as the temperature of the heating element rises, the contact between the third and fourth contacts is broken and contact is made between the fourth contact and a fifth contact (normally, the fourth and fifth contact connection is open, only closing upon a certain degree of rod expansion). This new connection continues to supply power to the warning light since the fifth contact is linked to the power supply. Thus, continued heating of the element will keep the warning light lit to indicate that the surface is also too hot to touch. In addition, because of the orientation of the fourth and fifth contacts, further expansion and contraction of the rod, that will cycle the heating element so that it does not overheat, will not break the connection between the fourth and fifth contacts. Thus, the high temperature warning light remains on during cycling of the heating element. The connection between the fourth and fifth contacts breaks when the rod contracts as a result of element cooling. In this event, the power to the heating element would have been off for a sufficiently long time to allow the element surface to cool to a safe temperature, thereby permitting the rod to contract and disconnect power to the high temperature warning light, i.e., open the switch connection between the fourth and fifth contacts and close the switch connection between the third and fourth contacts.

As stated above, the switch is ideally suited for cooking stove tops, particularly those using glass or ceramic tops for electrical heating elements. However, the switch could be used in other applications where it is desired to know that a specific heating element amongst a plurality of elements is on and is too hot to touch. Any types of electrical heating elements are deemed suitable for the invention.

In one embodiment, the switch unit is preferably used in a circuit comprising an infinite switch for each element, a common remote power light and a heating element. A plurality of heating elements are used, each using the circuit described above so that each heating element has its own indicator of power as well as a hot or unsafe surface temperature indicator. The switch unit is situated between the infinite switch and the heating element and is connected to the incoming power supply in two locations so that the high temperature warning light has a power supply even when power to the heating element is turned off.

In this embodiment, with the common power-on light off but the high temperature warning light still lit, a user will know that the power is off to the heating elements but that the one with the warning light still on is not safe to touch. When the common power-on light is on, the warning light will also be on to indicate power to that element and a high temperature surface condition. The warning light will remain on until a safe surface temperature condition occurs, regardless of whether the heating element is energized.

While a temperature sensitive rod is disclosed, other temperature sensitive structures could be employed to make or break connections between contacts in the switch unit. Moreover, since these temperature sensitive elements are well known in the art, the actual configuration or design to achieve the desired movement within the switch unit to indicate the presence of a hot surface associated with a given heating element is within the skill of the art.

The inventive method comprises indicating that at least one heating element of a plurality of heating elements is energized and has a high temperature surface associated therewith. The method entails providing a plurality of heating elements and energizing at least one of the heating elements. Further, the method includes indicating that the at least one heating element is energized and further indicating that a surface associated with at least one heating element is at an unsafe temperature when the at least one heating element is either in an energized condition or a deenergized condition.

BRIEF DESCRIPTION OF THE DRAWINGS

Reference is now made to the drawings of the invention wherein.

DESCRIPTION OF THE PREFERRED EMBODIMENTS

The improvements over prior art switches and limits for electrical heating elements is achieved by locating a warning light close to each heat source so that the user is informed with instantaneous feedback indicating which heating element is turned on and additionally indicating which sections of the cooktop are hot enough to cause injury, whether the power to the heater in that section is on or off.

Figure 1:
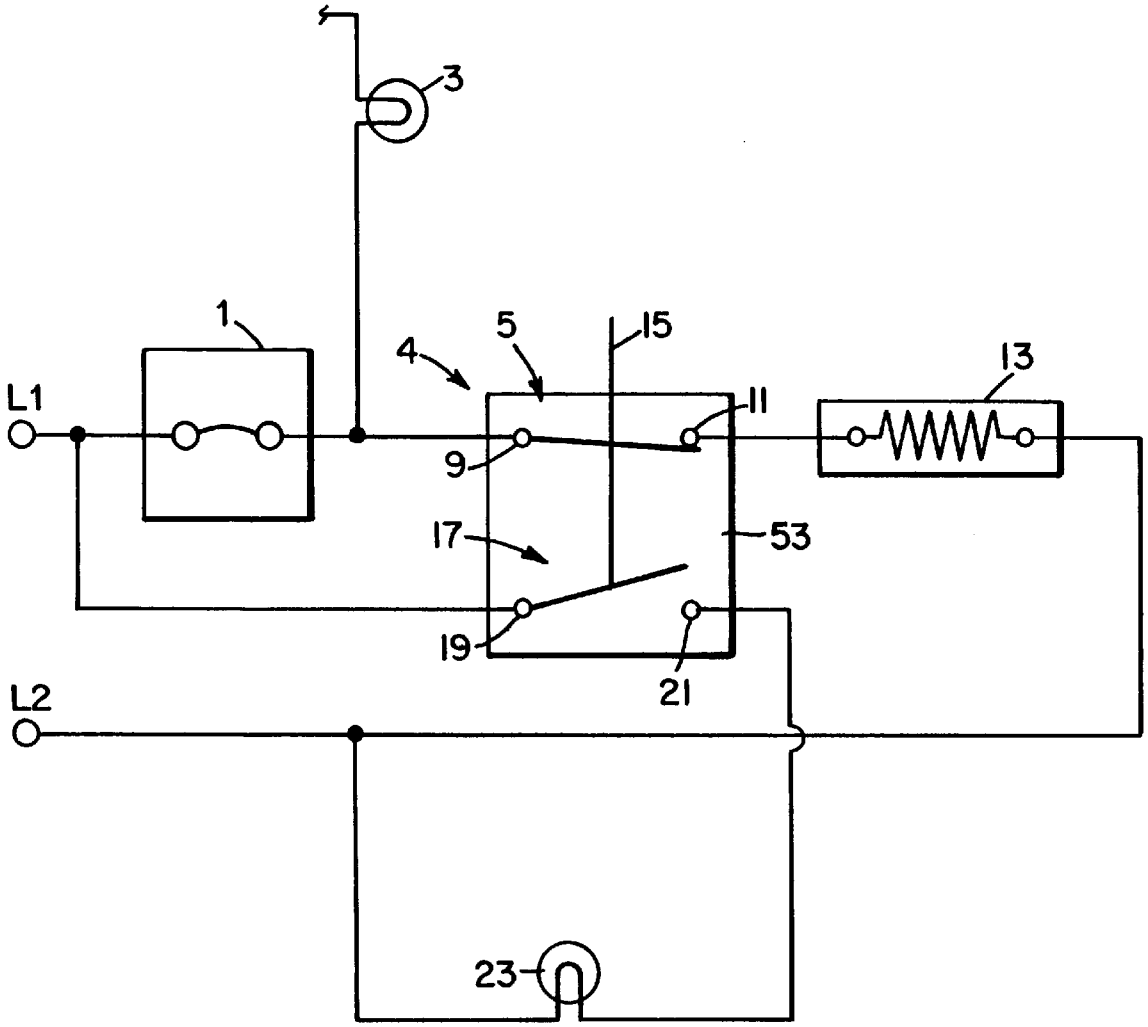
Fig. 1 PRIOR ART
FIG. 1 illustrates a prior art high temperature limit switch-common remote high temperature warning light circuit.
Figure 2:
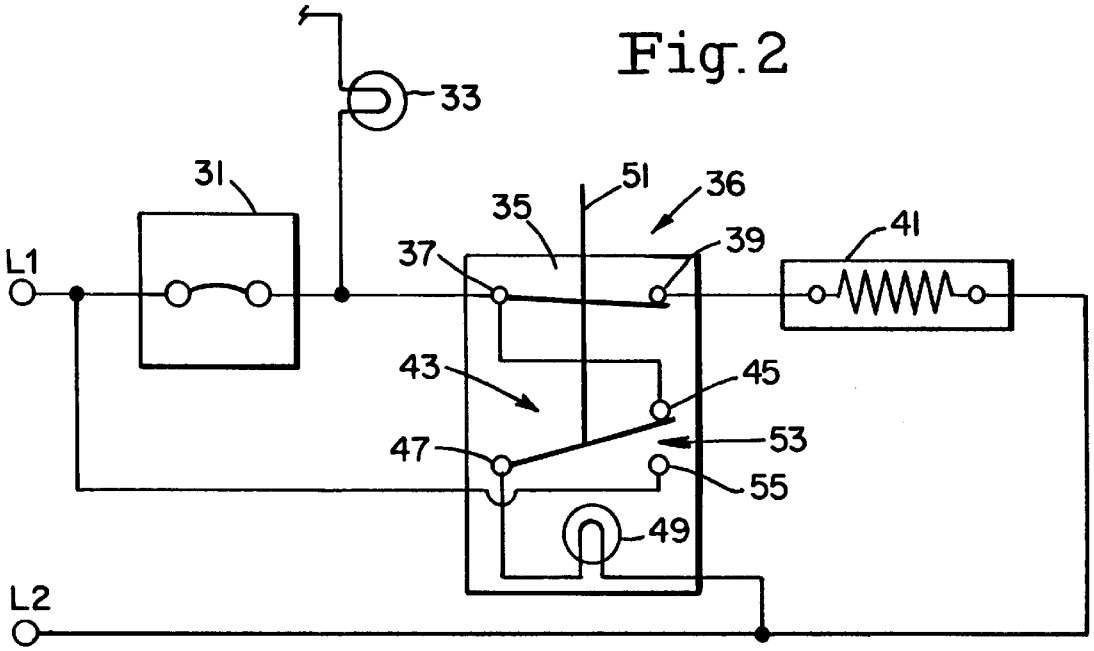
FIG. 2 illustrates one embodiment of the invention.

One embodiment of the invention is depicted in FIG. 2 but the invention is not deemed limited thereto. An exemplary sequence of the operation of the inventive switch is described below.

In a first step, an infinite switch 31 is manually turned on. Current then flows from the main power supply L1, through the infinite switch 31 and to the common remote power-on light 33. The current continues to flow through a switch 35 in unit 36, the switch 35 employing normally closed first and second contacts 37 and 39. A sensing rod 51, located in the unit 36, is positioned in the proximity of the heating element 41 and the glass (not shown) so that the heating element temperature can be controlled and the glass surface temperature can be monitored. The current also flows to a warning light switch 43, in unit 36, employing a single pole, double throw switch with a common contact 47, a normally closed contact 45, and a normally open contact 55. By virtue of the normally closed position of switch 43, the current also flows to the warning light 49 in unit 36, and back to the main power supply L2. At the same time, the current flows through the heating element 41 and then back to the main power supply L2. When the heating element 41 is energized, the warning light 49 is immediately energized giving the end user a visible indication of which heating element is on.

In a second step, the heating element 41, by virtue of turning infinite switch 31 to the on position, begins to heat up or have its temperature rise. As a result of this temperature rise, the sensing rod 51, by its proximity to the element 41, in the unit 36 starts to expand. At a predetermined temperature, the sensing rod 51 trips the switch 43 from the normally closed position, where contacts 45 and 47 are connected, to a position, where 45 and 47 are disconnected, and where the contact 47 and the contact 55 are connected. Opening the normally closed switch 43 thereby routs current from L1 through contacts 55 and 47, through the warning light 49 and back to L2. As long as the temperature is high enough, the sensing rod 51 will have sufficient length to ensure that switch 43 remains in the normally open position whereby the connection between contacts 55 and 47 is made so that the warning light 49 stays on indicating a hot surface.

The limiting action of the unit 36 will now be described. As the heating element 41 continues to heat, the sensing rod 51 in the unit 36 expands and opens switch 35, breaking the connection between the contacts 37 and 39 and disconnecting the power to the heating element 41. When the element 41 cools sufficiently, the sensing rod 51 in the unit 36 cools, its length shortens, thereby closing switch 35. Continued heating and cooling affects the length of the sensing rod 51, thereby cycling the heating element 41 between an off and an on condition to limit the heating element's output to a safe level.

As long as the temperature of the glass (not shown) covering the element 41 is high enough, the sensing rod 51, by its proximity to the glass, will remain at sufficient length to keep switch 43 in the normally open position (no connection between 45 and 47, connection between 55 and 47) insuring that the warning light 49 remains on, even though switch 35 is cycling the heating element 41 between the on and off states.

In step 3, the current to the heating element 41 is turned off by turning the switch 31 to the off position. This will shut off the power light 33, if no other elements are on. However, the warning light 49 will remain on until the sensing rod 51 shortens or contracts as a result of element cooling. When a certain degree of contraction is achieved, the switch 43 changes to its normally closed position (connection between 45 and 47) and cuts off power to the warning light 49 from L1, thereby indicating that the glass or cooking surface has cooled to a point below a predetermined temperature deemed safe for the end user to touch without injury.

Figure 3:
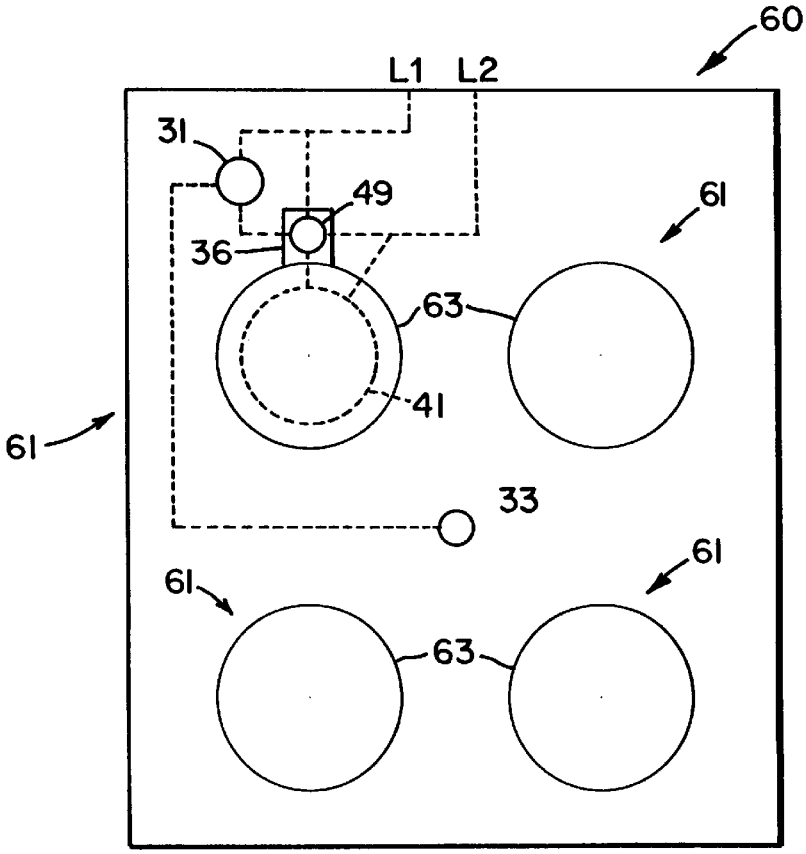
FIG. 3 illustrates a schematic depiction of the invention in an exemplary use.

FIG. 3 depicts a range top 60 with the unit 36 in use with a plurality of range top burners 61. Each burner 61 has a glass or ceramic cover 63. Each burner also has a heating element represented by the reference numeral 41, the switch 31, the common power light 33 and the unit 36 with warning light 49 to indicate power to the element 41 and the existence of a hot surface as described above and shown in FIG. 2. For clarity purposes, only one burner is shown with the circuitry in FIG. 3. The unit 36 associated with each burner 61 permits a user to know which burner is both turned on and which burner has a dangerously hot glass or ceramic surface. With the prior art switch, a user would only know that one of the four burners has a hot surface, but not necessarily which one.

The inventive unit 36 can be employed with any heating element where it is important for a user thereof to know that the element has a hot surface, not just in cooking appliances. For example, multiple burners may be employed in a laboratory setting whereby safety would require notice or indication that one or all of the burners are too hot to touch. Further, the unit 36, while disclosed with an infinite switch, common power light and heating element, could be utilized with other electrical components as would be within the skill of the art to make another type circuit or heating element system.

The unit depicted in FIG. 2 is considered to depict one embodiment representing the aforementioned means to both indicate the hot surface of each element regardless of whether the heating element is on or off and that power was supplied to the element. As described above, other components of the inventive unit and circuit can be utilized.

As such, an invention has been disclosed in terms of preferred embodiments thereof which fulfills each and every one of the objects of the present invention as set forth above and provides new and improved high temperature limit, a high temperature warning and power indicator switch, a circuit using the switch and a heating element system.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. In high temperature limit switches for heating elements having means to illuminate a single hot surface warning light, the improvement comprising a switch having a temperature sensitive element capable of disconnecting power to a heating element to prevent overheating, a series of contacts and a warning light, the element and contacts configured to illuminate the warning light when power is supplied to the heating element and to illuminate the warning light until a surface of an energized heating clement cools to a safe to touch temperature wherein the switch has a normally closed first set of contacts which open upon a set expansion of the temperature sensitive element to deenergize the heating element, and a second set of three contacts which in a first state illuminate the warning light when the heating element is energized and which in a second state illuminate the warning light independently of energization of the heating clement when the temperature sensitive element expands as a result of a surface associated with the heating element reaching an unsafe temperature.

2. A temperature limiter for controlling the temperature of a heating element comprising:

a first switch having a first position for connecting said hearing element to a first power line and a second position for disconnecting said hearing element from said first power line;

a high temperature warning indicator;

a second switch having a first position for connecting said warning indicator to said first power line and a second position for connecting said warning indicator to a second power line;

a temperature-responsive controller operatively connected to said first switch and said second switch for shifting said second switch to said second switch's second position when the temperature at the controller rises above a first level and for shifting said first switch to said first switch's second position when the temperature at the controller rises above a second level.

3. A temperature limiter according to claim 2 wherein said second level is higher than said first level.

4. A temperature limiter according to claim 2 wherein said temperature responsive controller comprises a sensing rod.

5. A temperature limiter according to claim 2 wherein said temperature controller places said first switch in said first switch's first position when the temperature at said sensor is below said second temperature and places said second switch in said second switch's first position when the temperature at said sensor is below said first temperature.

6. A temperature limiter according to claim 2 further including a third switch having a first position for connecting said power line to said power source and a second position for disconnecting said power line from said power source.

7. A temperature limiter for an electric heating element comprising:

a temperature-responsive controller; and a high temperature warning indicator, wherein said temperature-responsive controller limits the temperature of the heating element and activates said warning indicator when current is flowing through said heating element and when the temperature of said heating element is above a given temperature, and wherein said temperature-responsive controller comprises a sensing rod.

* * * * *